United States Patent [19]

Pepper et al.

[11] 4,072,516

[45] Feb. 7, 1978

[54] GRAPHITE FIBER/METAL COMPOSITES

[75] Inventors: Roger T. Pepper, Cape Elizabeth; Thomas A. Zack, Scarborough, both of Maine

[73] Assignee: Fiber Materials, Inc., Biddeford, Maine

[21] Appl. No.: 613,333

[22] Filed: Sept. 15, 1975

[51] Int. Cl.[2] ..... H01B 1/04; H01C 1/04

[52] U.S. Cl. ..... 75/229; 75/DIG. 1; 252/503; 252/504

[58] Field of Search ..... 75/DIG. 1, 229; 252/503, 504, 506, 507, 508, 509; 428/902, 367, 368

[56] References Cited

U.S. PATENT DOCUMENTS

| | | | |
|---|---|---|---|
| 3,443,301 | 5/1969 | Basche et al. | 75/DIG. 1 |
| 3,770,488 | 11/1973 | Pepper et al. | 428/367 |
| 3,796,587 | 3/1974 | Sara | 428/366 |
| 3,811,920 | 5/1974 | Galasso et al. | 428/368 |
| 3,833,402 | 9/1974 | Elban et al. | 428/367 |
| 3,894,863 | 7/1975 | Lachman et al. | 428/367 |

FOREIGN PATENT DOCUMENTS

| | | | |
|---|---|---|---|
| 2,164,568 | 7/1972 | Germany | 75/DIG. 1 |

*Primary Examiner*—Benjamin R. Padgett
*Assistant Examiner*—Josephine Lloyd
*Attorney, Agent, or Firm*—Schiller & Pandiscio

[57] ABSTRACT

A novel graphite fiber/metal composite material in which the graphite fibers have an adherent coating of silicon oxide and silicon carbide. The coating protects the graphite surface from attack by carbide forming matrix metals such as aluminum, titanium, magnesium and nickel. In a preferred embodiment of the invention the coating is formed by an intermediate temperature vapor deposition technique involving the reduction of silicon tetrachloride in the presence of hydrogen and an oxygen containing gas.

7 Claims, 2 Drawing Figures

GRAPHITE FIBER/METAL COMPOSITES

Figure 1:
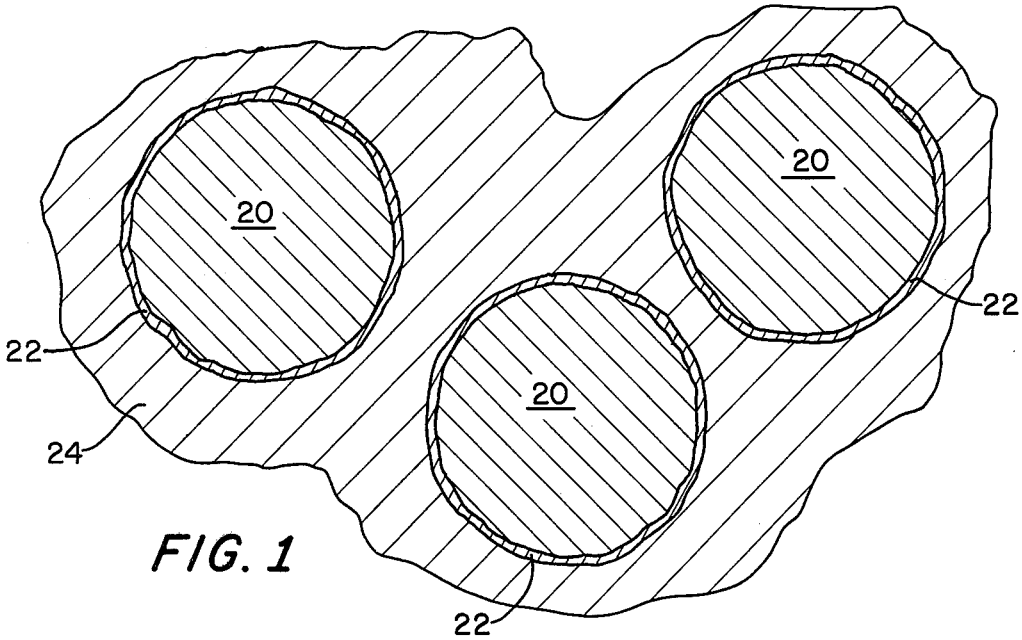

The present invention relates to composite materials, and more specifically to composites of carbon fibers embedded in a metallic matrix, and the method of making same.

High strength, low weight structures can be formed of composites of filaments embedded or bound in a matrix. Particularly, carbon fibers have high tensile strength and a high modulus of elasticity, so that composites formed of a metal matrix containing such fibers aligned in the direction of maximum expected stress can be readily used for components requiring high strength-to-density and high modulus-to-density ratios over a wide range of temperatures. Metal-graphite composites also combine the lubricating properties of graphite with the toughness of the metal to provide a material with a low coefficient of friction and wear resistance. Composites of graphite with metals such as aluminum exhibit high strength to density and stiffness to density ratios and thus have particular utility in application where weight considerations are important. Aluminum-graphite composites also exhibit relatively high electrical conductivity, thus may also find utility in transmission of electrical power.

It has been suggested that the graphite can be bonded to aluminum if an interface layer of aluminum carbide is provided between the metal and fiber. However, such metal-graphite composites occassionally may not possess the desired strength due to chemical attack of the fiber surfaces at high temperatures by the metal matrix to form the carbide of the metal. Such attack may occur during the high temperature formation of the composite, or the attack may take place under high temperature service conditions. The attack tends to notch the fiber longitudinal surfaces which causes substantial or even catastrophic reduction in fiber strength. This problem is particularly acute in the case of composites formed of aluminum and graphite fibers derived from polyacrylonitrile, the latter being a preferred precursor as having a low cost and desired mechanical properties.

Aluminum graphite fiber composites can be formed by first coating the fibers with a tantalum film by electro-deposition from a fused salt bath, outgassing the fibers by pumping them down to a very low pressure and submerging the outgassed fibers into a pressurized molten aluminum bath to fill the interstices of the fibers, in the manner described in U.S. Pat. No. 3,553,820 issued to Sara. The tantalum coating acts as a barrier to aluminum carbide formation and as a wetting agent to make possible the impregnation of fiber bundles with molten aluminum. The tantalum coating can also be applied by sputtering or by reduction of salts of the metal. However, tantalum is relatively expensive and heavy, and it is sometimes difficult to obtain uniform thin coatings on the fibers by the process.

Another process of forming metal-graphite composites involves liquid metal infiltration and forming a thin, substantially uniform coating of a wetting agent on the graphite fibers, the agent comprising titanium boride, titanium carbide or a mixture of both, according to the method disclosed in U.S. Pat. No. 3,860,443 issued to Lachman et al. According to this process, the coating of wetting agent is preferably formed by deposition from the vapor phase as a result of a simultaneous reduction of a mixture of a gaseous compound of titanium and a gaseous compound of boron, for example titanium tetrachloride and boron trichloride. Furthermore, metal-graphite composites formed using this technique also occasionally may not possess the desired strength because the titanium boride/titanium carbide coating reacts with the metal matrix and dissolves leading to carbide formation and degradation of the strength of the fibers.

A principal object of the present invention is therefore to provide a simple, unique process for forming metal/graphite fiber composites which overcomes the aforesaid problems of the prior art. Another object of the present invention is to provide a process for protecting graphite fibers from attack by carbide forming metals. Still another object of the present invention is to provide a unique, high strength metal/graphite composite which is relatively inexpensive to produce. Yet other objects of the present invention will in part appear obvious and will in part appear hereinafter.

The invention accordingly comprises the process and the several steps and the relation of one or more of such steps with respect to each of the others, and the products and compositions possessing the features, properties and relation of elements which are exemplified in the following detailed disclosure and the scope of the invention all of which will be indicated in the claims.

Generally to effect the foregoing and other objects the present invention involves a thin, substantially uniform adherent coating comprising an intimate mixture of both silicon oxide and silicon carbide on graphite fibers. The silicon oxide and silicon carbide coating is preferably deposited on the graphite fibers by the vapor phase reduction of silicon tetrachloride under conditions that produce silicon carbide either concurrently with the formation of silicon oxide or the formation of silicon oxide occurring thereafter. The coating of silicon oxide and carbide provides a barrier to protect the fiber surfaces from chemical attack by carbide-forming metals.

Figure 2:
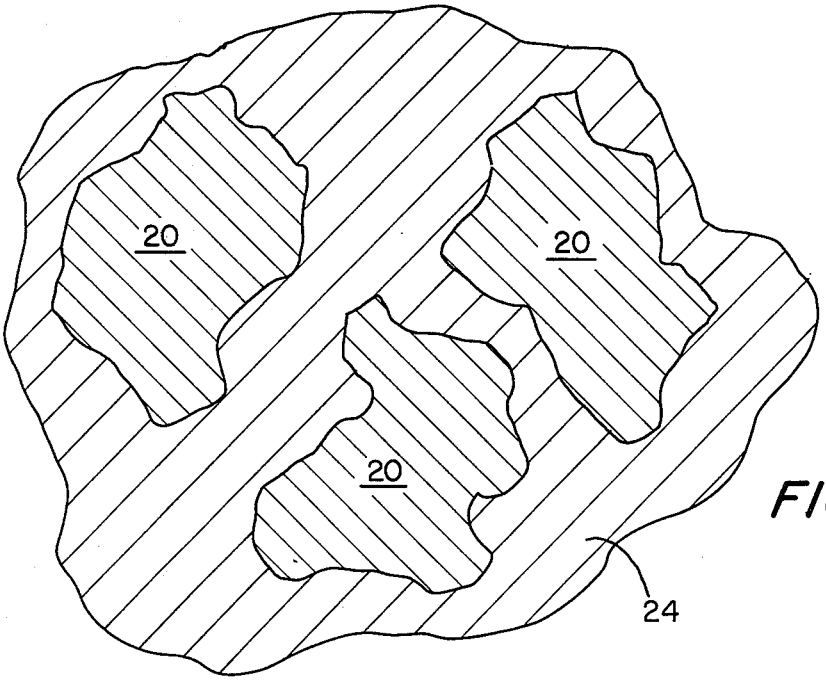

For a fuller understanding of the nature and objects of the present invention, reference should be had to the following detailed description taken in connection with the accompanying drawings wherein:

FIG. 1 is a diagramatic illustration, in cross-section of a carbon-fiber metal composite produced according to the teachings of the invention; and FIG. 2 is a diagramatic illustration, in cross-section of a carbon-fiber metal composite similar to that of FIG. 1, but having no protective interface barrier.

Although graphite fibers are preferred in the practice of the instant invention it is intended that the term "carbon fibers" should include both graphitic and non-graphitic carbon fibers. The carbon fibers used in the invention may be made from any of a large number of precursors such as pitch, rayon, polyacrylonitrile or the like in the form of yarn, tow, webs which are woven, knitted, felted, and the like. In a preferred form, the fibers are graphite derived from uniaxial polyacrylonitrile yarn of 6 – 8 micron average fiber diameter. Such carbon fibers and textiles are well known and available commercially, and the method of producing same is well known in the art.

The composite material of the invention comprises, as shown in FIG. 1 of the drawings, a plurality of graphite fibers 20 each having a substantially ahderent continuous surface coating 22 comprising silicon oxide and silicon carbide. The coating thickness may be very thin, but for the sake of clarity the relative thickness of the coating in the drawing has been exaggerated. The fibers of the composite material are embedded in a solid metallic matrix 24 which may be aluminum, magnesium, titanium, nickel, various alloys of these metals such as aluminum/magnesium and the like, and alloys which comprise one of these metals in major proportion.

The coating of the invention is a substantially uniform layer of silicon oxide and silicon carbide preferably having a thickness in the range between 100 to 10,000 A. While there are many techniques for coating fibers, the preferred method in the present invention involves a high temperature vapor phase deposition of the silicon oxide and silicon carbide coating by the reduction of gaseous silicon tetrachloride with gaseous hydrogen and the presence of oxygen or an oxygen containing gas such as carbon dioxide, water vapor or air. The deposition process is conducted at an elevated temperature in the range of about 600° C to 1800° C. The deposition can be conducted either with or without diluent or inert gas in the reaction atmosphere. Typically, the reactant gas concentrations will be adjusted to comprise about 50 to 70% silicon tetrachloride, 20 to 40% hydrogen and 1 to 10 oxygen containing gas such as carbon dioxide (all percentages by volume percent).

The overall chemical reactions are believed to occur as follows:

$$(1)\ SiCl_4 + H_2 + CO_2 \xrightarrow{1550^\circ C} SiO_2 + HCL + CO$$

$$(2)\ SiCl_4 + H_2 + C \xrightarrow{1550^\circ C} SiC + HCL$$

The foregoing equations are believed to be only approximations. The molar ratio of silicon oxide to silicon carbide which results in the final coating is proportional to the relative molar ratio of hydrogen and oxygen in the initial gas phase. The relative amounts of silicon tetrachloride and the oxygen compound should be adjusted to provide a finished coating which comprises about 20–80 weight percent of silicon carbide, the balance silicon oxide.

This latter consideration is important because to achieve a satisfactory composite material, it is desirable that the coating provide a chemically stable interface between the fiber and the metal of the matrix. For example, if the metal being used for infiltration is aluminum or an aluminum alloy with a high percentage of magnesium, a coating rich in silicon oxide is preferred. On the other hand, if the infiltrating metal is an aluminum alloy with a high percentage of copper, it is preferred that the coating should be rich in silicon carbide.

Alternatively, the silicon oxide and silicon carbide can be produced on the fibers by a two step deposition process which entails a first step of reducing gaseous silicon tetrachloride with hydrogen to thereby form a coating comprising a mixture of unbound silicon and silicon carbide, and thereafter exposing the formed coatings to air or an oxygen containing gas, all at elevated temperatures in the range of 600° C to 1800° C. Other methods known in the art such as sputtering and vacuum ion plating may also be used to deposit the silicon oxide and silicon carbide coatings on the graphite fibers.

Fibers with the silicon oxide and silicon carbide coating are then incorporated into the aluminum using liquid metal infiltration techniques employing a wetting agent such as titanium boride/titanium carbide, in accordance with the process disclosed in Lachman, U.S. Pat. No. 3,860,443, or the silicon oxide and silicon carbide coated fibers may be infiltrated directly with the metal matrix, e.g. as by using powder metallurgy techniques. The entire process can be carried out at ambient pressure preferably under an inert atmosphere such as argon or the like. The metal-fiber mass is then allowed to cool thereby forming a solid composite material. Sections of composite material, which can be originally made in the form of wires, rods, tapes or sheets, can be pressed together at a temperature either below or above the melting point of the matrix in known manner to give bulk composites of various shapes such as bars, angle sections and panels. If desired, during the liquid state pressing of such shapes, any excess matrix metal may be expressed from the composite material in order to increase the volume percentage of the fibers.

The following examples illustrate more clearly the manner in which carbon fiber composite materials are produced according to the invention. The invention however should not be construed as being limited to the particular embodiments set forth in the examples.

EXAMPLE I

A. Polyacrylonitrile precursor graphite yarn containing approximately 10,000 individual fibers of $50 \times 10^6$ p.s.i. modulus was coated with a mixture of silicon oxide and silicon carbide by exposure to a vapor reaction mixture formed of 67 vol. % $SiCl_4$, 32 Vol. % $H_2$ and 1 vol. % $CO_2$. The gas mixture was maintained at a temperature of 1550° C for five minutes to provide a substantially uniform coating of about 100 A, believed to comprise substantially silicon oxide and silicon carbide in a weight ratio of 1 to 1, on the yarn fibers. The silicon oxide/silicon carbide coated fibers were then coated with a mixture of titanium boride and titanium carbide by exposure to a vapor reaction mixture formed of 0.38 wt. % $TiCl_4$, 0.21 wt. % $BCl_3$, and 0.80 wt. % Zn, the balance argon. The gas mixture was maintained at a temperature of 650° C for 30 minutes to provide a coating of about 200 A, of $TiB_2$ and TiC as wetting agent on the silicon oxide/silicon carbide coated fibers. The coated fibers were then transferred under argon to a molten bath of aluminum containing 5% by weight of copper then drawn through the bath at 670° C at a rate of six inches per minute. The resulting metal-fiber composite was removed from the bath and then allowed to cool to below the solidus temperature of the alloy. A section taken across the long axis of the fibers through the composite appeared substantially as shown in FIG. 1 in the drawing.

B. An aluminum 5 weight % copper-graphite composite was prepared as in part (A) hereinabove with the following exception: The molten metal was applied directly to uncoated yarn using the Lachman TiB/TiC wetting agent without any silicon oxide and silicon carbide interface barrier. A section taken across the long axis of the fibers of the resulting composite appeared substantially as shown in FIG. 2 or the drawing. The fiber surfaces were observed to be attached by the molten metal.

The tensile strengths of the composites produced in (A) and (B) above were tested and the results were as follows:

| | | Tensile Strength (psi) | Percentage of Theoretical |
|---|---|---|---|
| (A) | (With $SiO_2$/SiC interface) | $125 \times 10^3$ | 95% |

-continued

| | Tensile Strength (psi) | Percentage of Theoretical |
|---|---|---|
| (B) (No interface) | $39 \times 10^3$ | 36% |

EXAMPLE II

The graphite yarn similar to that used in Example I was exposed to a similar gas mixture at 1,550° C for five minutes to provide a substantially uniform coating on the fibers of about 100 A, of silicon oxide and silicon carbide in a weight ratio of about 1 to 1. The coated fibers were then chopped into 1/32 inch lengths and mixed with fine aluminum powder (10–20 micron). The powder-fiber mixture was then transferred to an aluminum tube which was sealed under vacuum. The mixture was heated to about 550° C; and the heated mixture was drawn to a fifty percent reduction in area. The drawing process was observed to consolidate the powder-fiber mixture and align the fibers in a substantially longitudinal direction. The drawn composite was allowed to cool to form a solid article of high strength.

EXAMPLE III

Polyacrylonitrile graphite yarn similar to that used in Example I was exposed to a similar gas mixture at 1550° C for 5 minutes to provide an adherent, substantially uniform coating on the fibers of about 100° A thickness of silicon oxide and silicon carbide in a weight ratio of about 1 to 1. The coated fibers were then chopped into 1/32, inch lengths and mixed with 10 – 20 micron particle size titanium powder and sealed under vacuum in a titanium tube. The titanium tube and fiber powder mixture were heated to 600° C and the mixture was drawn to a fifty percent reduction in area. The drawing process consolidated the titanium matrix of the composite and was observed to align the discontinous graphite fibers in the longitudinal direction. The drawn article was allowed to cool and form a solid article of high strength.

Since certain changes may be made in the above process and product without departing from the scope of the invention herein involved, it is intended that all matter contained in the above description or shown in the accompanying drawing shall be interpreted in an illustrative and not in a limiting sense.

What is claimed is:

1. A composite product comprising a plurality of carbon fibers each having a coating of a mixture of silicon oxide and silicon carbide, said fibers being disposed in a substantially solid matrix of metal.

2. A composite as defined in claim 1 wherein said metal is a carbide forming metal selected from the group consisting of aluminum, magnesium, titanium, nickel, alloys of said metals, and alloys which comprise one of said metals in major proportion.

3. A composite as defined in claim 1 wherein said fibers are substantially graphite.

4. A composite was defined in claim 1 wherein the thickness of said coating is in the range of between about 100 to 10,000 Angstroms.

5. A composite as defined in claim 3 wherein said metal comprises aluminum.

6. A composite as defined in claim 3 wherein said metal comprises magnesium.

7. A composite as defined in claim 3 wherein said metal comprises titanium.

* * * * *